US005441207A

United States Patent [19]

Bock et al.

[11] Patent Number: 5,441,207

[45] Date of Patent: Aug. 15, 1995

[54] DIFFERENTIAL GEAR WINDING DEVICE FOR BOBBINS

[75] Inventors: Erich Bock, Wettstetten; Hermann Adolf; Romeo Pohn, both of Ingolstadt, all of Germany

[73] Assignee: Rieter Ingolstadt Spinnereimaschinenbau AG, Ingolstadt, Germany

[21] Appl. No.: 73,860

[22] Filed: Jun. 8, 1993

[51] Int. Cl.[6] ..... B65H 67/044

[52] U.S. Cl. ..... 242/18 DD

[58] Field of Search ..... 242/18 DD

[56] References Cited

U.S. PATENT DOCUMENTS 4,415,125 11/1983 Schwengeler ..... 242/18 DD
4,695,800 9/1987 Fretz et al. .
4,938,427 7/1990 Wionsek .

FOREIGN PATENT DOCUMENTS 261950 1/1990 Czechoslovakia .
0063690 11/1982 European Pat. Off. .
0230943 8/1987 European Pat. Off. .
3616406A1 2/1988 Germany .
3446259C2 12/1988 Germany .
3823403A1 1/1990 Germany .
4040650A1 6/1992 Germany .

*Primary Examiner*—Daniel P. Stodola
*Assistant Examiner*—Michael R. Mansen
*Attorney, Agent, or Firm*—Dority & Manning

[57] ABSTRACT

A winding device, in particular for conical bobbins, including; a rotatable friction roller which rotates a bobbin through friction. The friction roller consists of several rotatable elements installed next to each other which are mounted on a shaft. One of the elements is connected non-rotatably with the shaft, the other elements of the friction roller are freely rotatable on the shaft and are connected to each other by a differential gear transmission. The differential gear transmission is in the form of a friction wheel transmission. The axes of the friction wheel transmission are at a perpendicular to the shaft.

22 Claims, 3 Drawing Sheets

DIFFERENTIAL GEAR WINDING DEVICE FOR BOBBINS

BACKGROUND OF THE INVENTION

A device in which a rotatable friction roller comprising several cylindrical rotation elements arranged in a row on a common driving shaft is used to wind up yarns on a rotatable tube is known from EP 0063 690 A1. One of these rotation elements is attached fixedly on a shaft so that the friction roller is driven. The tube or bobbin which is in contact with this friction roller presses against the rotatable friction roller and is driven by the latter. To be able to also drive conical tubes or bobbins, the friction roller is provided with a differential gear thanks to which the friction roller has different circumferential speeds at its two ends to drive the bobbin. To drive the friction roller, its central area is firmly attached to the drive shaft. The two outer portions of the friction roller are rotatable in relation to the drive shaft.

A similar friction roller is known from DE 34 46 259 C2. With this device, the part which is firmly connected to the drive shaft is provided with a cover which is freely rotatable in relation to the drive shaft.

DE 36 16 406 A1 discloses another device where the toothed wheel rotating together with the drive shaft is a bevel wheel which meshes with corresponding toothed wheels of the two rotatable elements. Labyrinths are used to prevent yarns or dirt from infiltrating between the rotatable elements.

DE 38 23 403 discloses the utilization of friction gearing whereby the axes of the friction wheels are parallel to the axis of the winding roller. This device has the disadvantage that in particular its friction wheel gearing is delicate and cannot bear much load. Only friction wheels with relatively small diameter can be used here. Sufficient pressure between friction wheel and running surface is not ensured.

CS 261 950 B1 discloses a winding device for conical bobbins with a differential gear in which the transmission of force is effected by means of friction. A ring which rotates with the drive shaft is attached to the latter for this purpose. This ring is provided with recesses in which balls are inserted. The friction surfaces of the rotation elements lie axially against the latter. A spring exerts axial force upon the bearing which can be shifted in relation to the drive shaft so that one rotation element is connected interlockingly via the balls to the other rotation element. The disadvantage of such a friction drive is the fact that it has great internal friction. Another disadvantage is the fact that constant translation ratios are not ensured. Only a point-shaped contact exists between the contact surfaces. Due to the limitation of the space into which the balls are inserted in the radial direction, only relatively small balls can be used, and this further worsens the drive conditions.

A winding device with toothed wheel differential gearing where the rotational elements are also mounted so as to be capable of axial shifting is known from DE-A 40 40 650. The disadvantages of this device are that it is very expensive. The axial shiftability contributes to the fact that gears or bearing locations can no longer be sealed off sufficiently from their environment. The winding device must be stopped for cleaning, since toothed-wheel gear transmissions make it impossible to stop one of the rotation elements during operation. This involves the danger that gears of the rotation element would be destroyed due to the high rotational speeds.

In known winding devices, meshing teeth are usually used for the transmission of the movement. These have however the disadvantage that they are expensive and delicate, that a precise adjustment of the winding roller is required and that they are not suitable for higher rotational speed. Higher rotational speeds occur especially when part of the winding roller is stopped by hand, for example, in an attempt to remove dirt, e.g. yarns, from the gap between the parts of the winding roller into which they may have been pulled. In such a case, the gears are subjected to high loads which could lead to a destruction of toothed-wheel gear transmissions. The friction gear transmissions known in the state of the art are also not suitable in practical use because of the disadvantages described above.

It is a further disadvantage of the known winding devices that they can be put out of commission by dirt, e.g. yarns pulled into the devices. Blockage of the gear transmission, e.g. by yarns, as well as due to the jamming of yarns in the gaps between the parts of the friction roller, causes the transmission function to be interrupted so that the entire friction roller rotates over its entire length at the same circumferential speed. It is another disadvantage of the known devices that the driving shaft must be stopped to be cleaned so that access is afforded in the area of the gear transmission or between two parts of the friction roller, for example. Furthermore the friction rollers must be disassembled at least in part for maintenance, which is time consuming. This causes long stoppage times of the machine with the winding devices according to the state of the art.

OBJECTS AND SUMMARY OF THE INVENTION

It is a principal object of the instant invention to create a winding device which avoids the disadvantages of the state of the art, which is constructed simply and is not delicate and which can be serviced also during the operation of the machine, and which is equipped in such manner with respect to its component as to be impervious to entering foreign particles.

Additional objects and advantages of the invention will be set forth in the following description, or may be learned by practice of the invention. By utilizing a friction wheel which rotates together with the shaft driving the friction wheel, a less expensive, less delicate gear transmission is created which is suitable for high rotational speed and makes a simple construction of the device possible. The utilization of a friction wheel causes the gear transmission to be impervious to high rotational speeds, so that even blockage of a gear transmission element for instance, can be survived by the gear transmission without damage. Furthermore, the adjustment of the individual gear transmission parts in relation to each other can be effected easily through the invention by using a friction wheel, in that the gear transmission elements driven by the friction wheel are pressed upon the latter by spring force.

By using several friction wheels in the gear transmission it is possible to distribute the load uniformly over the elements of the winding device. By using a cup-shaped element which is installed around the elements of the friction roller rotating together with the shaft, it becomes possible to provide the bobbin with a plane contact surface in this area of the friction roller. The cup-shaped element can be in the form of a pipe or may consist of a divided pipe. It is furthermore possible for the element to be connected intimately with the shaft and to rotate with it. It is at the same time also possible to design the element so that it is mounted rotatably in relation to the shaft. Due to the perpendicular position of the axis of the friction wheel in relation to the shaft, a reversal of rotational direction for the two elements interacting with the friction wheel is not necessary. In the state of the art, where the axes of the transmission gear wheels are parallel with the shaft, the reversal of the direction of rotation is obtained either by means of inside and outside toothing or by means of an additional toothed wheel. Due to the cambered configuration of the running surface of friction wheel or opposing running surface, advantageous running characteristics are achieved. By using an elastic material as the coating of at least one of the running surfaces, advantageous frictional conditions and good damping within the gear transmission are advantageously achieved.

It is especially advantageous if the element rotating together with the shaft is constituted simply by the attachment means of the friction wheel and if the latter is at the same time the axis around which the friction wheel rotates. By using a sleeve to contain the elements, the attachment means is attached to same.

It is especially advantageous for the friction wheel to be provided with a basic body made of plastic, for example, on which the running surface is applied. This makes it possible to use advantageous materials for both parts. The running surface is advantageously constituted by an elastic component, whereby the running behavior is influenced advantageously. In addition, the running surface can be attached to the basic body by its own tension. It is especially advantageous for this component to be ring-shaped, e.g. an O-ring made of an elastomer. A sliding bearing is an especially simple, low-cost support of the friction wheel. A bearing by means of a ball bearing is especially low in friction. It is especially advantageous for such a bearing to be provided with a seal, at least on its side away from the shaft, since this can prevent the lubricant of the bearing from being ejected from the bearing by the centrifugal force.

The friction wheel has advantageously a diameter greater than the distance between the cup covering the element rotating together with the shaft and the shaft or the sleeve. As a result, the running behavior of the gear transmission is influenced very favorably. At the same time the design according to the invention of the winding device makes it possible to use a large friction wheel, even when the space available for installation is low in radial direction. It is especially advantageous if the friction wheel has a diameter from 10 mm to 55 mm, depending on the outside diameter of the winding roller.

The fact that the elements of the friction roller are brought towards each other by means of an elastic element, e.g. one or several springs, makes it possible for the gear transmission to adjust itself. It is therefore possible to always ensure for the friction wheel transmission that the interacting surfaces are always subjected to a favorable load. In addition, axial shifting of the freely rotatable elements is made possible. This has the advantage that the interval between the freely rotatable element and fixed element of the friction roller can be enlarged, so that caught yarn particles, for example, can be removed. This can be done in the embodiment of the device according to the application even during operation, i.e. while the shaft rotates. Because the differential gear transmission is in the form of a friction wheel transmission, it is no problem, when the two interacting elements have been uncoupled, to couple the gear transmission back together again. The friction wheel transmission according to the invention is able to overcome without difficulty through slip the speed differences which then occur. It is especially advantageous for the force, which is produced in axial direction by the elastic elements, to be adjusted so that an axial shifting of the elements can be effected manually. The freely rotatable elements of the friction roller are supported advantageously on roller bearings that are attached to the shaft or to a sleeve installed on the shaft. The rotatable elements in turn are supported on the bearings by means of elastic elements, so that an axial shifting on the bearings is made possible. Thus an interval between the elements of the friction roller can be enlarged so that particles which have entered can be removed. The elastic elements by means of which the freely rotatable friction roller elements are supported are advantageous especially because they have a slighter resistance against shifting, so that an axially shifted element of the friction roller remains at least temporarily in that position.

The winding device is advantageously provided with a seal between the freely rotatable element and the element rotating together with the shaft. This is advantageously in the form of an interval seal, i.e. a contact-seal with downstream contacting seal. Thus the entry of dirt or yarns into the interior, e.g. the gear transmission of the winding roller, can be avoided. It is especially advantageous if a storage area or free space is provided between these two seals. This storage serves to receive dirt and fibers which have passed the first seal and prevents blockage between freely rotatable and rotating element to be provoked by even small amounts of dirt. The contacting seal makes it possible to avoid with certainty that dirt which has infiltrated can penetrate to the interior.

The present winding device can be maintained in a most advantageous manner if a maintenance device, which represents a separate invention, is used. It is advantageously attached, hooked on to a fixed part of the machine or leaned against it so that by means of spring-actuated brake shoes it may first brake the freely rotatable element of the friction roller which is to be shifted for maintenance, and then to shift it in axial direction. Once the shifting has taken place, the storage area is accessible for the removal of dirt so that yarn particles drawn in while the machine was running and while the friction roller was partially slaved, can be removed. This is especially advantageous so that machine stoppage periods may be avoided. The invention shall be described below through drawings.

DETAILED DESCRIPTION OF THE PREFERRED EMBODIMENTS

Figure 1:
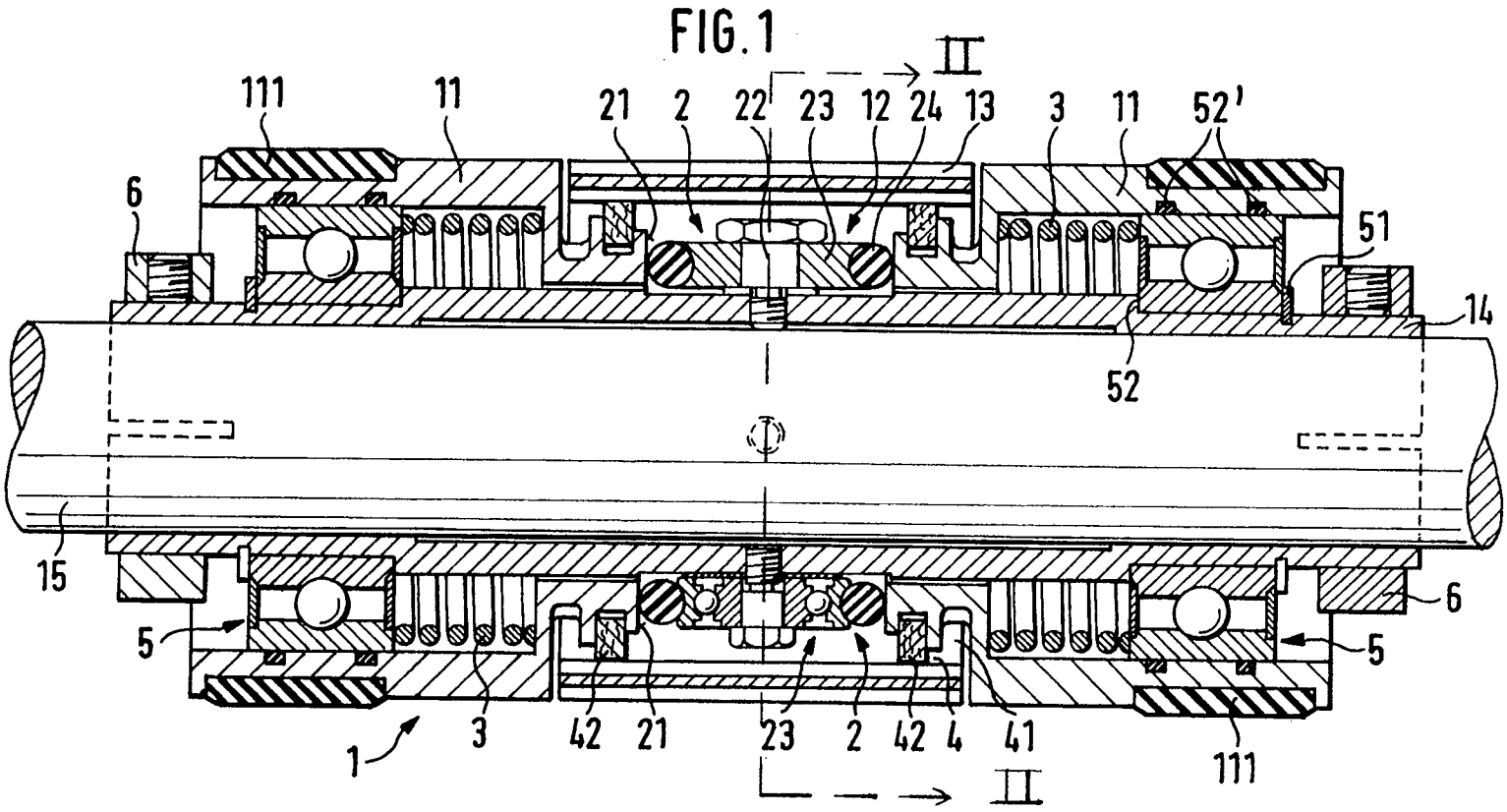
FIG. 1 shows a longitudinal section through a friction roller of a device according to the invention.

Reference will now be made in detail to the presently preferred embodiments of the invention, one or more examples of which are illustrated in the drawings. Each example is provided by way of explanation, and not limitation of the invention. The numbering of components in the drawings is consistent throughout the application, with the same components having the same number in each of the drawings.

Figure 2:
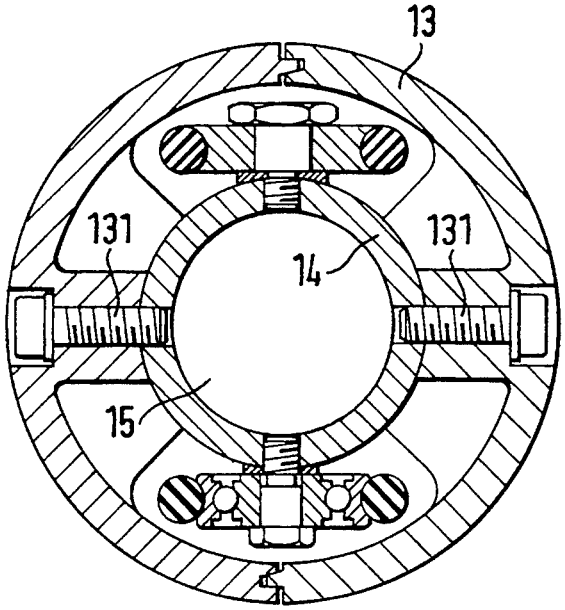
FIG. 2 shows a section through the device of FIG. 1.

The friction roller 1 of FIG. 1 consists of two freely rotatable elements 11 and an element 12 which rotates together with the shaft 15. The element 12 which rotates together with the shaft consists essentially of the friction wheel 2 which is connected to sleeve 14 by means of a screw connection attachment 22. In the present case, two friction wheels are attached on the sleeves so that uniform running of the differential gear transmission of the friction roller 1 is ensured. The differential gear transmission is made up of friction wheel 2, which interacts with the opposing surfaces 21 of the freely rotatable elements 11. The element 12 rotating together with the shaft is covered by a cup 13 (FIG. 2) which is in turn attached on the sleeve and therefore rotates at the same rotational speed as the driven shaft 15. As can be seen in FIG. 2, the cup 13 has a split design so that disassembly and uncovering of the friction wheel for maintenance during machine stoppage is easy and rapid. The freely rotatably elements 11, which are located on the left and right sides of the element 12, press with their opposing surfaces 21 against the friction wheel. They are pressed against the friction wheel 2 by the elastic elements 3 which bear upon the bearings 5. The elements 11 are supported on the outer rings of bearing 5 which are in turn attached on sleeve 14 by means of a connecting element 51 and by contact against a shoulder 52 of sleeve 14. The freely rotatable elements 11 press against the outer ring of each bearing 5 via two elastic intermediary elements 52' which can also be made in the form of O-rings. This type of connection makes it possible to shift the freely rotatable elements 11 axially towards the outer ring of bearing 5. The shifting movement can go so far that the labyrinth 4 and the storage 41 become accessible from the circumference of the friction roller. Sleeve 14 which supports the elements 11 and 12 is in turn mounted on a shaft running along the spinning or winding machine and is attached by means of clamping rings 6.

On the outer circumference of each of the freely rotatable elements 11, a friction coating 111 is applied, which the bobbin to be driven contacts. The bobbin does this generally by way of its border beards which form during bobbin build-up. FIG. 1 shows two different types of friction wheels 2, whereby the upper one is mounted with its basic body 23 on the screw connection 22 with a slide bearing so as to be capable of gliding, while the basic body of the friction wheel shown on the bottom consists of a roller bearing. The running surface 24 (FIG. 4) of the friction wheel is applied on the basic body 23. In the present instance this is a ring made of an elastic material and having a circular cross-section. It interacts with a flat opposing surface 21 of the free rotatable elements 11. It has been shown to be especially advantageous for a curved running surface to interact with a flat running surface. It is also possible to make the opposing surfaces 21 cambered. The axes of the friction wheels 2 are perpendicular to the sleeve 14 to which they are attached so that they are also perpendicular to the shaft (not shown) onto which the sleeve 14 has been pushed. The perpendicular arrangement of the axes of the friction wheels of the differential gear transmission of the instant friction roller allows for especially simple and low-cost construction of the differential gear transmission shown here. In this arrangement, the simultaneous rotational direction of the left freely rotatable element 11 contrary to that of the right freely rotatable element 11 is achieved by means of only one gear transmission.

The storage 41 is not only sealed off from the friction wheel via labyrinth 4, but at the same time a felt ring 42 is installed on each of the freely rotatable elements 11 for additional screening of the interior space of the gear transmission against dirt and other particles having infiltrated the storage area.

The freely rotatable elements 11 are able to rotate more rapidly or more slowly than the element 12 which rotates together with the shaft, so that conical bobbins which have different circumferential speeds at their two ends are driven at precisely such circumferential speeds. By using a friction wheel as part of the differential gear transmission, in particular in combination with the vertical arrangement of the axis of the friction wheel, an especially simple, space-saving and robust differential gear transmission is created for the instant friction roller.

It is at the same time possible that one of the freely rotatable elements can be stopped without overloading the differential gear transmission. This is because the friction wheel of the instant invention is able to handle the high rotational speed produced thereby between one freely rotatable element and the other freely rotatable element. Due to the axial shiftability of the freely rotatable elements 11, it is possible to clean the storage 41 of infiltrated particles at low cost, and this is absolutely possible during the operation of the machine. In this case the freely rotatable elements can be shifted to the outside at the same time or one after the other, because even a simultaneous blocking of the freely rotatable elements 11 is compensated for by the slipping of the friction wheel 2 on the opposing surface 21. Preferably however, one freely rotatable element is first stopped, the storage 41 is cleaned, and then shifted back into normal position, whereupon the second freely rotatable element is shifted and serviced.

FIG. 2 shows a section along the axes of the friction wheels 2 of FIG. 1. In this drawing it can be seen that the cup 13 can be divided. It is attached by means of screws 131 to the sleeve 14 which is in turn installed on the shaft 15 which transmits its rotational movement to the friction roller 1.

Figure 3:
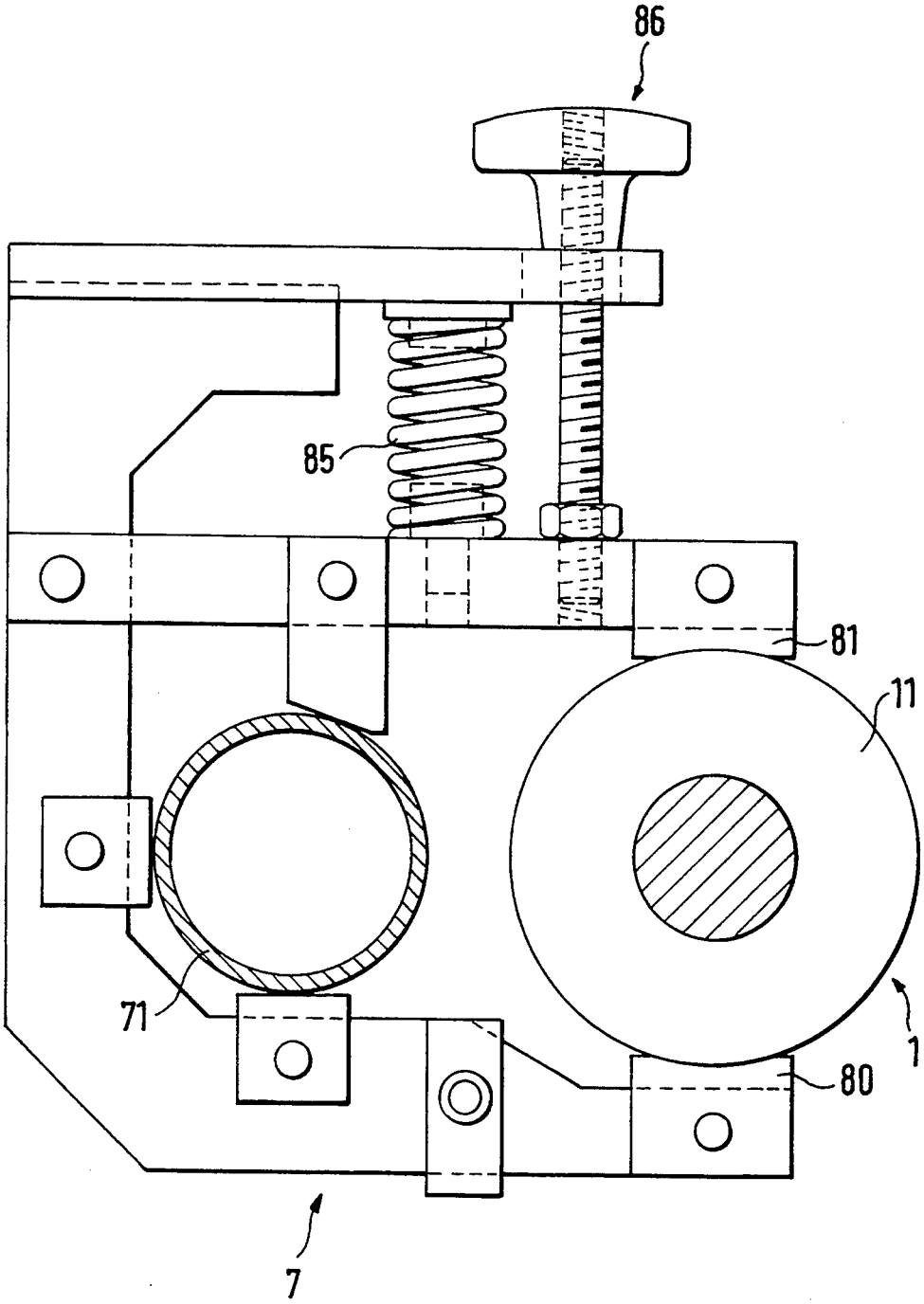
FIG. 3 shows a side view of the maintenance device of the friction roller according to the invention.

FIG. 3 shows a maintenance device 7 which is hooked on a pipe 71 of the machine frame and which surrounds the freely rotatable element 11 of a friction roller 1 and stops it with two brake shoes or plates 80 and 81. The radial force of the brake plates 80 and 81 is produced by a spring 85 so that the danger that the freely rotatable elements may be damaged during braking is eliminated. To relax the brake shoes, the spring 85 is compressed by means of a screw 86. The attachment of the maintenance device 7 on the machine frame can be effected in various manners, depending on the design of the machine. Thus it is not necessary for the maintenance device 7 to surround a pipe, as in the present case, in order to establish a support of the maintenance device on the machine frame.

Figure 4:
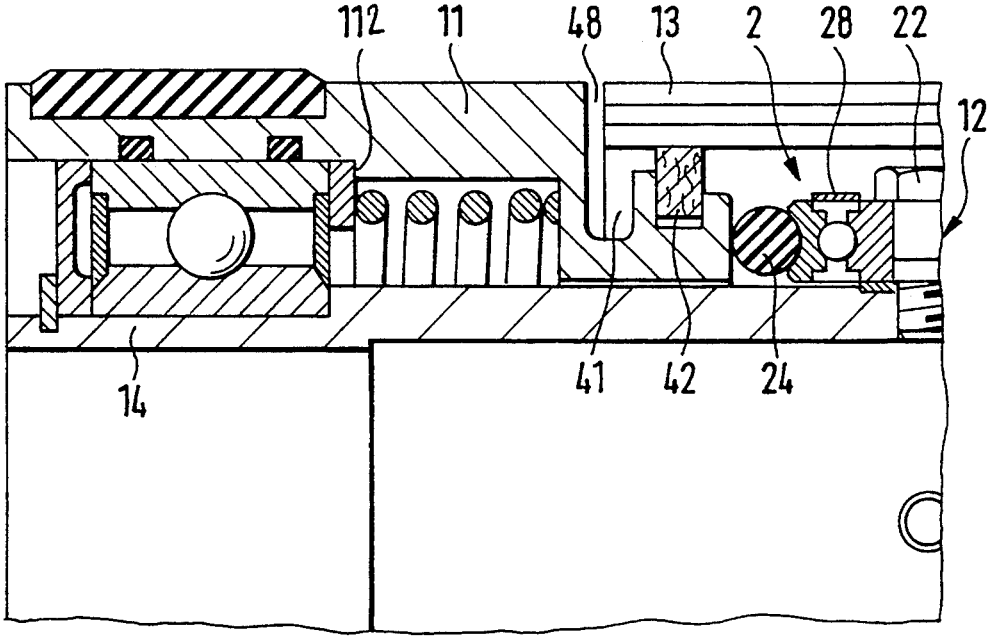
FIG. 4 shows part of the winding roller in a section and enlarged.

FIG. 4 shows an enlarged representation of a part of the winding device, i.e. friction roller 1. The freely rotatable element 11 and the element 12 which rotates together with the shaft are both installed on a sleeve 14 which is pushed over a shaft as in FIG. 1 and is attached on same. The friction wheel 2 is a friction wheel on roller bearing and is attached to the sleeve 14 by means of its screw connection 22 which constitutes at the same time the rotational axis of the friction wheel 2. The running surface 24 of the friction wheel 2 consists of a rubber ring which is held on the friction wheel by its own tension. The ball bearing of the friction wheel 2 is provided with a sealing plate 28 which is located on the side of the bearing away from the shaft. This sealing plate 28 prevents the lubricant of the bearing to be ejected from the bearing by the centrifugal forces produced by the rotation of the friction wheel 2 around the axis of the sleeve or shaft. The freely rotatable element 11 is provided with a stop 112 so that it cannot be shifted axially. In such an embodiment it is sufficient to simply stop the freely rotatable element 11 so as to be able to remove dirt. In case of especially severe soiling, it is necessary to stop the shaft and remove the cup 13 which is screwed onto the sleeve by means of screws as shown in FIG. 2. In order to seal off the freely rotatable element 11 against the element 12 rotating together with the shaft, a seal is provided which is constructed in the manner of a labyrinth and has an additional, contacting seal 42. In order to prevent the intrusion of dirt, the seal first constitutes a contactless seal in form of a gap 48. This gap is formed by the side of the freely rotatable element 11 and the side of the cup 13 which is part of the element rotating together with the shaft. Behind the contact-less seal 48, as seen in the direction of the intruding dirt, a contacting seal 42 in form of a felt ring is installed. Thus the penetration of dirt into the interior of the winding device or friction roller 1 is safely prevented. The differential gear transmission is thus protected from dirt. A storage area 41 in which infiltrated yarns, fibers or other dirt can accumulate is provided between the contact-less seal 48 and the contacting seal 42. Since infiltration can never be prevented completely, the storage area 41 ensures that the rotatability of the freely rotatable element is not affected by even small amounts of dirt. The rotatability of the freely rotating element 11 is therefore blocked only when the storage area 41 is completely full. However, since this only occurs with a large amount of infiltrated dirt, the device is able to operate for a long period of time without disturbance, even when some dirt has already passed the contact-less seal 48. It will be apparent to those skilled in the art that various modifications and variations can be made in the present invention without departing from scope or spirit of the invention. For instance, features illustrated or described as part of one embodiment can be used on another embodiment to yield a still further embodiment. It is intended that the present invention cover such modifications and variations as come within the scope of the appended claims and their equivalents.

We claim:

1. A bobbin winding device for driving a bobbin, said device comprising a drive shaft and a rotatable friction roller disposed concentric on said drive shaft, said friction roller comprising a plurality of rotatable elements disposed adjacently on said drive shaft, at least two of said rotatable elements being freely rotatable relative to said drive shaft, said friction roller further Comprising a differential gear operably disposed between said freely rotatable elements and operably connected to said shaft so as to rotate therewith, said differential gear comprising at least one differential friction wheel disposed in driving contact with said freely rotatable elements, said differential gear further comprising a radially extending member for each said differential friction wheel fixed relative to said shaft so as to rotate therewith, each said differential friction wheel rotatably mounted on a respective said radially extending member so as to rotate relative to said radially extending member about an axis essentially perpendicular to the rotational axis of said drive shaft.

2. The device as in claim 1, wherein said freely rotatable elements comprise bobbin contacting surfaces for driving engagement with a conical bobbin, whereby opposite ends of said conical bobbin are driven at different corresponding circumferential speeds.

3. The device as in claim 1, further comprising a plurality of said differential friction wheels spaced at regular intervals about said shaft.

4. The device as in claim 1, wherein said radially extending members comprise an axle secured to said fixed rotatable element extending perpendicularly from said fixed rotatable element, each said differential friction wheel rotating about a respective said axle.

5. The device as in claim 4, further comprising a cup-shaped cover disposed about said fixed rotatable element and each said differential friction wheel.

6. The device as in claim 1, wherein each said differential friction wheel comprises a diameter which is greater than the radial distance between said shaft and said cover.

7. The device as in claim 6, wherein each said differential friction wheel comprises a diameter within the range of about 10.0 to 55.0 millimeters.

8. The device as in claim 1, wherein at least one said differential friction wheel comprises a cambered running surface disposed in driving running contact with said freely rotatable elements.

9. The device as in claim 8, wherein said at least one differential friction wheel comprises a base body, said cambered running surface disposed radially about said base body.

10. The device as in claim 1, further comprising resilient members disposed so as to axially bias said freely rotatable elements towards said at least one fixed rotatable element.

11. The device as in claim 1, wherein at least one said differential friction wheel comprises a slide bearing device for rotation about said respective radially extending member.

12. The device as in claim 1, wherein said differential friction wheel comprises a ball bearing device for rotation about said respective radially extending member.

13. The device as in claim 1, further comprising a sleeve disposed concentric with said shaft and rotatably fixed thereto, said freely rotatable elements carried by said sleeve and rotatable relative thereto.

14. The device as in claim 13, further comprising bearing devices disposed between said freely rotatable elements and said sleeve.

15. The device as in claim 14, wherein said freely rotatable elements are connected to said bearings through elastic elements disposed about said bearings, said elastic elements preventing undesired axial slip of said freely rotatable elements relative said shaft during normal operations while allowing for desired axial readjustment of said freely rotatable elements.

16. The device as in claim 1, wherein said cambered running surface comprises a ring-shaped resilient component fitted on said base body.

17. The device as in claim 16, wherein said resilient members comprise springs disposed about said shaft and adjacent the side of said freely rotatable elements opposite from said fixed rotatable element.

18. The device as in claim 17, wherein at least one of said freely rotatable elements can be axially adjusted along said shaft relative said other freely rotatable element.

19. The device as in claim 18, wherein said axially adjustable freely rotatable element can be shifted axially by hand.

20. The device as in claim 1, further comprising sealing devices operably disposed between said freely rotatable elements and said fixed rotatable element, said sealing devices preventing the intrusion of dirt or particles into the area of said differential friction wheel.

21. The device as in claim 20, wherein said sealing device comprises a non-contact labyrinth seal adjacent a contact seal.

22. The device as in claim 21, further comprising a void disposed between said labyrinth seal and said contact seal, said void providing a storage are for dirt or particles which penetrate said labyrinth seal.

* * * * *